US006301713B1

(12) United States Patent
Aceves et al.

(10) Patent No.: US 6,301,713 B1
(45) Date of Patent: Oct. 16, 2001

(54) APPARATUS FOR NURSING

(75) Inventors: Athena A. Aceves; Tracy D. Bristol, both of Kihei, HI (US)

(73) Assignee: Maui Mommies, Inc., Monterey Park, CA (US)

( * ) Notice: Subject to any disclaimer, the term of this patent is extended or adjusted under 35 U.S.C. 154(b) by 0 days.

(21) Appl. No.: 09/614,426

(22) Filed: Jul. 12, 2000

(51) Int. Cl.[7] ..... A41D 1/20
(52) U.S. Cl. ..... 2/104; 2/69
(58) Field of Search ..... 2/104, 105, 106, 2/69, 102, 114, 273

(56) References Cited

U.S. PATENT DOCUMENTS

| | | | | |
|---|---|---|---|---|
| D. 303,995 | | 10/1989 | Dameron . | |
| D. 322,709 | | 12/1991 | Keola . | |
| D. 403,488 | | 1/1999 | Mitchell . | |
| 1,424,215 | * | 8/1922 | Rowe | 2/104 |
| 2,665,426 | * | 1/1954 | Schmidt | 2/104 |
| 2,698,943 | * | 1/1955 | Thompson et al. | 2/102 |
| 2,722,685 | * | 11/1955 | Lucas | 2/104 |
| 2,857,599 | * | 10/1958 | Wallace | 2/104 |
| 3,013,274 | * | 12/1961 | Dike | 2/104 |
| 3,155,984 | * | 11/1964 | Derrick | 2/104 |
| 4,468,816 | * | 9/1984 | Kaufer | 2/104 |
| 4,567,611 | | 2/1986 | Kendrick . | |
| 4,651,349 | | 3/1987 | Heiler . | |
| 4,697,287 | | 10/1987 | Rose . | |
| 4,712,251 | | 12/1987 | Cobble . | |
| 4,797,953 | * | 1/1989 | Dameron | 2/104 |
| 4,964,172 | * | 10/1990 | Bollard | 2/104 |
| 4,995,116 | * | 2/1991 | Beauchamp et al. | 2/104 |
| 5,005,217 | * | 4/1991 | Bern et al. | 2/104 |
| 5,008,960 | | 4/1991 | Hemming . | |
| 5,088,117 | * | 2/1992 | Fulmer | 2/114 |
| 5,090,059 | * | 2/1992 | Kahl | 2/104 |
| 5,182,813 | | 2/1993 | Booze . | |
| 5,469,582 | | 11/1995 | Livingston . | |
| 5,544,364 | | 8/1996 | Weber . | |
| 5,570,474 | * | 11/1996 | Berry et al. | 2/104 |
| 5,592,692 | * | 1/1997 | Larson | 2/104 |
| 5,652,958 | * | 8/1997 | Farrell-Mestas | 2/48 |
| 5,652,960 | * | 8/1997 | Kaknevicius | 2/104 |
| 5,950,235 | * | 9/1999 | Tata | 2/48 |
| 5,960,471 | | 10/1999 | Burton . | |

* cited by examiner

*Primary Examiner*—Gloria M. Hale

(57) ABSTRACT

The invention relates to a nursing apparatus which provides a user to privately nurse an infant. The nursing apparatus comprises: a first portion and second portion. The first portion comprises a front panel, an aperture, a first side, a second side and a waist edge, and is of sufficient size to substantially cover the frontal portion of a user. The second portion comprises a back panel, the aperture, the first side, the second side and the waist edge. The first portion and the second portion are integrally interconnected in a longitudinally aligned relation by the first side and a shoulder overlying portion.

15 Claims, 2 Drawing Sheets

APPARATUS FOR NURSING

BACKGROUND OF THE INVENTION

1. Field of the Invention

This invention relates generally to an apparatus, which provides a user such as a nursing mother or wet nurse, to privately breast feed an infant in a public environment. More particularly, the invention relates to a nursing blanket.

2. Description of the Prior Art

Many nursing women, such as a nursing mother or wet nurse, desire to have the option to conveniently nurse a child in public while simultaneously avoiding exposure herself. There exists many types of nursing coverings such as blankets and nursing garments or coverups for a nursing women for use in screening a mother's breast from view when in public. While traditional blankets and coverups have been used for this purpose, a blanket or coverup draped over a shoulder often will not enable the mother to view the breast feeding infant. Further, conventional blankets or coverups typically lack a way of securing the blanket or coverup to the mother, thus risking the possibility of slipping off, which can result in the exposure of a nursing mother's breasts.

Conventional blankets and coverups have been developed, however there are several disadvantages. Often these coverups can provide only a limited coverage area, and can be difficult to arrange, for example, such as a scarf type blanket and can either fall off or the mother may not have accessible view to the infant being breast fed. Further, holding mechanisms, such as for example, hook-like components, which can be used to secure the cover up to the nursing mother can be often uncomfortable. Additionally, pullover type coverups can make it difficult for the nursing mother to see the infant and the mother's hair can be messed up. Vest-like type garments can also be deficient in concealing a nursing mother's breasts from public or covering an infant since these garments often have insufficient material to cover the nursing mother and infant.

Thus, there is a present need for an apparatus which discreetly provides a user such as a nursing mother or wet nurse, to privately breast feed a child in a public environment. Further, it would be advantageous for the apparatus to allow the user to view the child while feeding, while preventing others from seeing inside. Still further, it would be advantageous to have the apparatus be easily accessible, versatile, simple in construction, inexpensive, comfortable, lightweight and flexible enough to be folded, yet also will remain in place while the infant is nursing. Still further, it would be advantageous for the apparatus to be fashionably styled, and be conveniently worn over a conventional article of clothing.

SUMMARY OF THE INVENTION

The invention relates to an nursing apparatus which provides a user to privately nurse an infant. The nursing apparatus comprises: a first portion and second portion. The first portion comprises a front panel, an aperture, a first side, a second side and a waist edge, and is of sufficient size to substantially cover the frontal portion of a user. The second portion comprises a back panel, the aperture, the first side, the second side and the waist edge. The first portion and the second portion are integrally interconnected in a longitudinally aligned relation by the first side and a shoulder overlying portion.

DETAILED DESCRIPTION OF THE PREFERRED EMBODIMENT

The present invention provides, in a first aspect, an apparatus for covering a user, such as a mother or wet nurse, during nursing to afford sufficient privacy and/or to provide a blanket for the infant. Another aspect of the present invention allows the user to view the child during feeding, while preventing others from seeing inside the apparatus. A further aspect of the present invention is to provide an apparatus that allows the user to wrap the infant in a warm blanket while nursing. Additional aspects of the present invention include an apparatus that will remain in place while the infant is nursing. Still further, the invention provides an apparatus that is simple in construction, inexpensive, lightweight and easily accessible such that, the apparatus is flexible enough to be folded or rolled into a small size to be placed into a diaper bag, purse or a knapsack. The present invention also provides an apparatus which can be quickly and easily attached around the mother.

Figure 1:
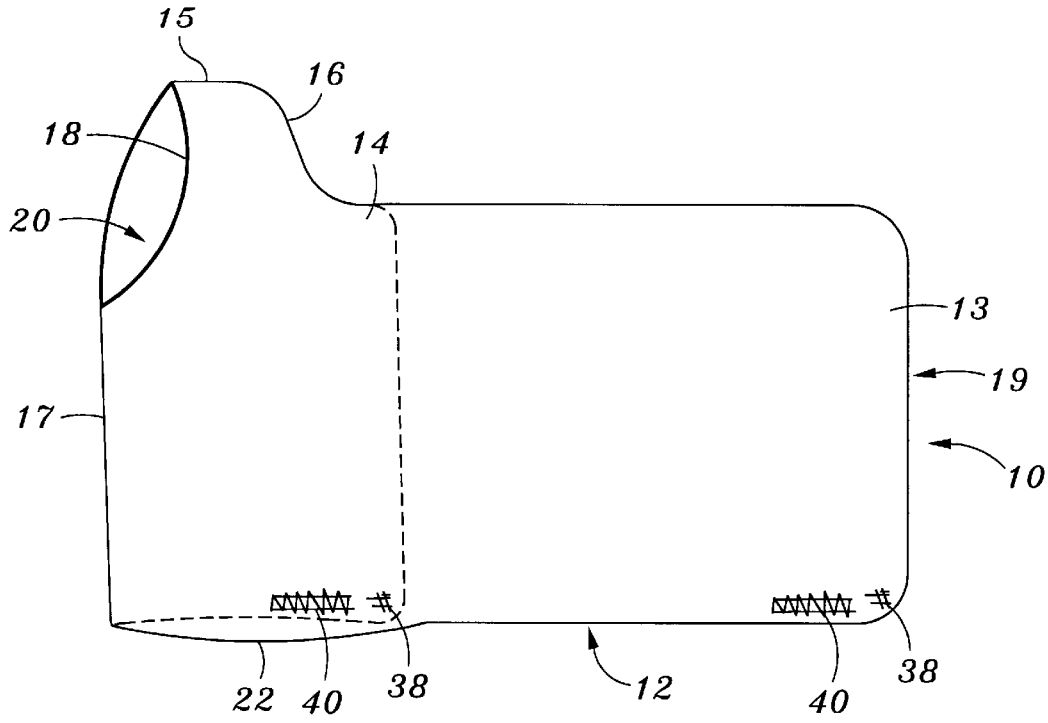
FIG. 1 illustrates a frontal view of the apparatus, which provides a user to privately breast feed a child in a public environment in accordance with the preferred embodiment of the present invention.
Figure 2:
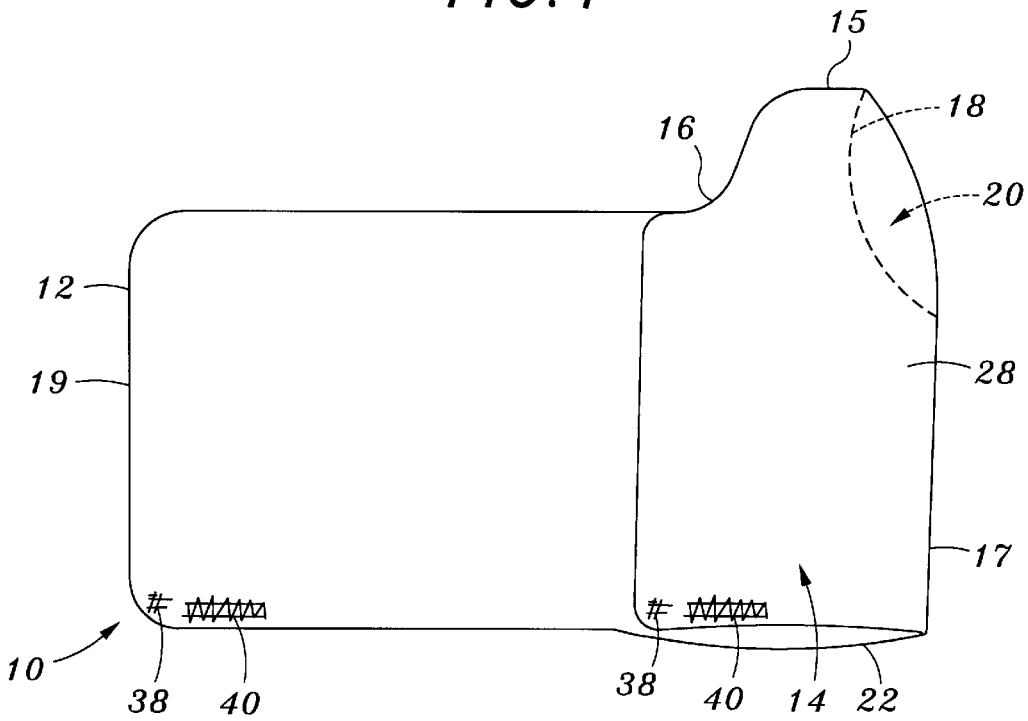
FIG. 2 is a back view of the apparatus in accordance with the preferred embodiment of the present invention.
Figure 3:
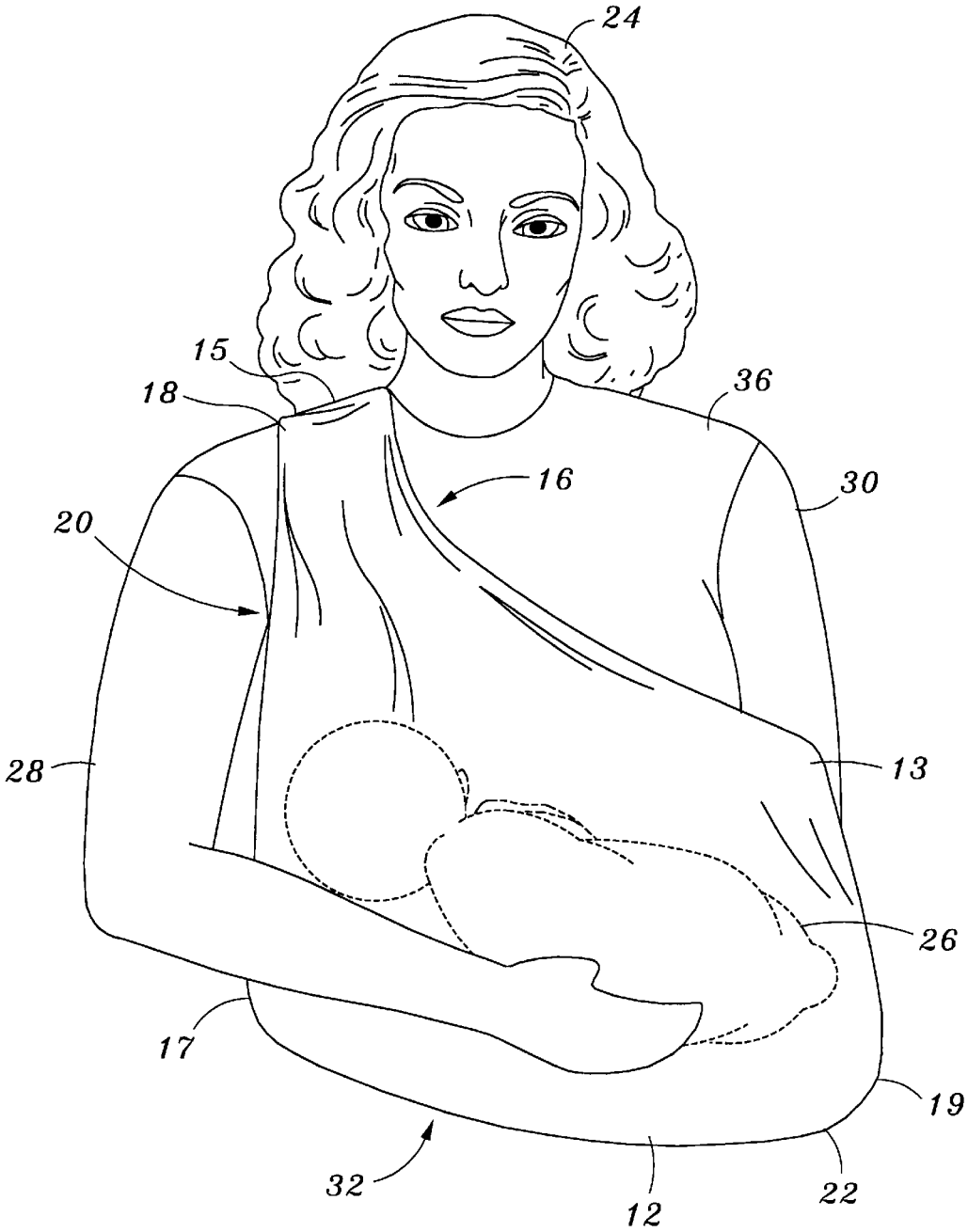
FIG. 3 is a frontal view of the apparatus as worn by a user in accordance with the preferred embodiment of the present invention.

In general, the present invention provides an apparatus which allows a user, such as a nursing mother or wet nurse, to privately breast feed a child in a public environment. In FIGS. 1–3, one embodiment of the components of the present invention are illustrated.

Referring now to FIG. 1, a frontal view of one embodiment of the apparatus 10 is illustrated. As is illustrated in FIG. 1, apparatus 10 provides privacy for a user as well as a covering for an infant. In particular, the apparatus 10 comprises a first portion 12 and a second portion 14. The first portion 12 comprises a front panel 13, an aperture surrounding a neck portion 16, a shoulder 15, a first side 17 comprising an arm hole edge 18 and an arm hole 20, a second side 19 and a waist edge 22. The first portion 12 is generally of rectangular shape, although any shape can be used for the purpose of covering, such that the first portion 12 is of a sufficient size to cover an infant and to prevent the user from being exposed during nursing. In one embodiment, the front panel 13 is of sufficient length such that the user and infant are sufficiently concealed during nursing and can be swaddle the infant. Along the top portion of the first portion 12, there is an aperture 16 which, in one embodiment, is substantially circular or round peripherally to cover a neck and shoulder 15. Along the first side of the first portion 12, there is arm hole 20 extending at the top from the shoulder 15 such that a user's arm can be slipped through. The waist edge 22 is typically the bottom part of the first portion 12. In one embodiment, waist edge 22 can be of any length sufficient to cover, conceal and swaddle an infant during nursing. Typically, on the side of the apparatus 10 with the arm hole 20, the nursing breast is covered, however, the infant can be nursed on the other breast. In one embodiment, the apparatus 10 is worn with the arm hole 20 with the front panel 13 covering the nursing breast such that maximum privacy can be obtained. Those with ordinary skill in the art can appreciate that the size of the arm hole 20 is typically sufficient enough to accommodate a typical user of any size and is generally larger than an average arm hole to alleviate pulling and tugging of the apparatus 10 by both the infant 26 and the user 24. The front panel 13 forms a continuous piece of a cloth member with the second portion 14 which, in one embodiment, is worn on the back of the user. First portion 12 and second portion 14 are joined at the shoulder 15 and along the sides 17 beneath arm hole 20 to waist edge 22.

The apparatus 10 may be formed of a single piece of material. Alternatively, the apparatus 10 may be formed from two or more pieces of material. In one embodiment, apparatus 10 is made of a cloth member. The cloth member, can be any light weight, soft, supple material (such as, for example, a suitable fabric such as cotton, wool, or a synthetic material). In a further embodiment, the cloth member is a fabric which is substantially soft, inexpensive, comfortable, lightweight and flexible enough to be folded, yet also will remain in place while the infant is nursing. Generally, the edges of the cloth member can be hemmed.

Referring now to FIG. 2, a back view of one embodiment of the apparatus 10 is illustrated. In particular, the apparatus comprises a first portion 12 and a second portion 14. The second portion 14 comprises a back panel 28, the aperture surrounding a neck portion 16, the shoulder 15, the first side 17 comprising the arm hole edge 18 and the arm hole 20, the second side 19 and a bottom portion 22. The second portion 14 is of a sufficient size to slip over a users arm and stay on to keep in place and is typically half the size in proportion to the first portion 12.

Referring to FIG. 3, illustrating one use of the apparatus 10 by a user 24 during nursing an infant 26. In use, the user 24 would insert an arm 28, intended to be used to cradle the infant 26, through the arm hole 20 and position the top portion of the arm hole edge 18 on the shoulder 15 of the user 24. The user's arm 28 can be bent allowing the elbow to be inserted into an inner cavity 32. The inner cavity 32 is underside the front panel 13 of the first portion 12. The front panel 13 can be used as a cover up in front to swaddle infant 26. Those with ordinary skill in the art can appreciate that when in use, apparatus 10 generally can resemble a vest-like garment worn backwards. The user 24 can then discreetly loosen or unfasten whatever conventional garments 36 beneath the front panel 13 by reaching underside the front panel 13. Once the user 24 has readied conventional garment 36 for nursing, the infant 26 can be placed underneath front panel 13 for nursing with the user's breasts completely concealed from public providing maximum non-exposure, maximum coverage and privacy.

It can be seen to those of ordinary skill in the art that the amount of the child extending within the inner cavity 32, is largely dependent on the size of the infant 26 and the positioning of the user 24 during nursing. In one embodiment, the front panel 13, can be adjusted to be taught or loose around infant 26. An opening to the inner cavity 32 can be created between the user 24 and the infant 26 by loosening the front panel 13 wrapped around infant 26, thus enabling the user 24 to view the infant 26 while feeding. The inner cavity 32 underside front panel 13 can provide access for the user 24 to manipulate her nipple or access to the infant if needed. In one embodiment, front panel 13 is wrapped around the infant 26 for support, yet is loose enough to provide ample ventilation for infant 26.

In one embodiment, the first portion 12 is of sufficient size both to cover the infant 26 and to prevent the user 24 from being exposed. The front panel 13 is of sufficient size to support and swaddle infant 26. During nursing, the user 24 can lift a portion of the front panel 13 to check on the infant 26. Typically, the user 24 can be a nursing mother, a wet nurse or any person who desires privacy while nursing an infant.

According to a one embodiment of the present invention, after the infant 26 has finished feeding, the above steps can be completely reversed and user 24 can rearrange conventional garment 36 beneath front panel 13. Although not showing, nursing can be permitted from the opposite breast in a similar matter to that illustrated in FIG. 3. Typically, apparatus 10 is removed and reversed, and the user 24 can place former free arm 30 through now reversed arm hole 20 and wear apparatus 10. Typically, the above steps are repeated such that the infant 26 can be nursed on the opposite breast of user 24.

According to another embodiment of the present invention, in order to avoid slippage, weights 38 can be utilized on the corners of apparatus 10, typically in the hem. Additionally, buttons and button holes, hooks and eyes, hook and loop fasteners, commonly known as VELCRO and other similar fastening devices 40 known to those skilled in the art can be incorporated into apparatus 10 to avoid slippage.

As will be apparent to one of ordinary skill in the art, if the infant is being bottle fed and not nursed, the apparatus of the present invention, can function as a blanket or wrap for the infant or a covering for the user. Additionally, in accordance with the present invention, the apparatus can be produced in a one size fits all which can easily be removed or worn.

Thus, the present invention provides a highly reliable, lightweight, simple, easy to use, yet economical apparatus that can be used by a user in public. The present invention includes a number of features and advantages. First the present invention provides a nursing apparatus for a user, that provides non-exposure, from the side or back, while the user is nursing. The present invention provides an apparatus that is reversible, versatile and easily transportable in a diaper bag, purse or knapsack. The present invention provides an apparatus that can be worn as a coverup over the user's clothing such that no special clothing is required. The apparatus of the present invention can be easily manufactured in many different materials of various types of fabric and can be machine washed without the need for dry cleaning. The apparatus of the present invention can be made in an elaborate ornamental material to accommodate a user who prefers wearing the apparatus in a dressy event. The apparatus of the present invention can easily be varied as long as the functional attributes of the present invention are not compromised. The illustrated garment is also easily reversible, so that the infant can be nursed on either side of the user. Additionally, ornamental trim or lining, or pockets, can be incorporated into the garment. Further, when detached, the apparatus can serve as a wrap for the infant or as a changing pad. The apparatus is serviceable to both nursing and non-nursing users.

Having now described the invention in accordance with the requirements of the patent statutes, those skilled in the art will understand how to make changes and modifications in the present invention to meet their specific requirements or conditions. Such changes and modifications may be made without departing from the scope and spirit of the invention as set forth in the following claims.

Although the present invention has been described in terms of certain preferred embodiments, other embodiments apparent to those of ordinary skill in the art are also within the scope of this invention. Accordingly, the scope of the invention is intended to be defined only by the claims, which follow.

What is claimed is:

1. A nursing apparatus, comprising:

a first portion and a second portion;

the first portion comprising a front panel having a front neck portion disposed between the first and the second portion, a first side comprising an arm hole edge and an arm hole, a second side and a waist edge, the first portion being of sufficient size to substantially cover the frontal portion of a user; and the second portion comprising a back panel having a back neck portion, the first side, the second side and the waist edge, wherein the first portion and the second portion being integrally interconnected in a longitudinally aligned relation by the first side beneath the arm hole edge to the waist edge and a shoulder overlying portion.

2. The apparatus of claim 1, wherein the apparatus is formed of a cloth member.

3. The apparatus of claim 2, wherein the cloth member is a supple material.

4. The apparatus of claim 3, wherein the material is selected from the group consisting of cotton, wool and a synthetic.

5. The apparatus of claim 1, wherein the front panel is separable from the user to form an inner cavity there between.

6. The apparatus of claim 5, wherein the front panel is separable from the user to form an inner cavity for allowing the user to reach inside the apparatus to manipulate an infant therein.

7.The apparatus of claim 6, wherein the front panel is separable from the user to form an inner cavity for allowing air circulation for the infant therein.

8. The apparatus of claim 7, wherein the front panel is separable from the user to form an inner cavity for allowing the user to view the infant therein.

9. As The apparatus of claim 1, wherein the apparatus further comprises a fastening device.

10. The apparatus of claim 9, wherein the fastening device can be selected from the group consisting of buttons and button holes, hooks and eyes, hook and loop fasteners.

11. The apparatus of claim 10, wherein the apparatus further comprises devices to prevent slippage of the apparatus.

12. The apparatus of claim 11, wherein the devices are weights.

13. The apparatus of claim 1, wherein the apparatus is reversible.

14. The apparatus of claim 1, wherein the front portion is of sufficient size to conceal from viewing, the arms and chest of the user and the infant while held in the arms of the user during nursing.

15. The apparatus of claim 1, wherein the front portion is at least long enough to wrap around the user's chest and shoulder and an infant.

* * * * *